US012655638B2

(12) United States Patent
Brotnov

(10) Patent No.: US 12,655,638 B2
(45) Date of Patent: Jun. 16, 2026

(54) MODULAR LEVEL ACCESS STRUCTURES

(71) Applicant: Russty Brotnov, Estacada, OR (US)

(72) Inventor: Russty Brotnov, Estacada, OR (US)

( * ) Notice: Subject to any disclaimer, the term of this patent is extended or adjusted under 35 U.S.C. 154(b) by 0 days.

(21) Appl. No.: 18/946,557

(22) Filed: Nov. 13, 2024

(65) Prior Publication Data

US 2025/0067056 A1 Feb. 27, 2025

(51) Int. Cl.
*E04F 11/035* (2006.01)
*E04F 21/26* (2006.01)

(52) U.S. Cl.
CPC ..... *E04F 11/035* (2013.01); *E04F 21/26* (2013.01)

(58) Field of Classification Search
CPC ..... E04F 11/02; E04F 11/022; E04F 11/035; E04F 11/116; E04F 2011/0203; E04F 2011/0212; E04F 21/26; E04B 1/34815; E04B 1/34823
See application file for complete search history.

(56) References Cited

U.S. PATENT DOCUMENTS 725,179 A * 4/1903 Uehling ..... E04F 11/02 52/185
1,362,069 A * 12/1920 Witzel ..... E04B 1/34815 52/745.03
3,052,332 A * 9/1962 Mulitz ..... E04F 11/02 52/694
3,175,654 A * 3/1965 Calvert ..... E04F 11/02 D25/63
3,228,154 A * 1/1966 Mulitz ..... E04F 11/02 52/185
3,292,327 A * 12/1966 Van Der Lely ..... E04B 1/34823 425/117
3,466,818 A * 9/1969 Van Der Lely ..... E04B 1/34815 52/404.1
3,593,469 A * 7/1971 Wall ..... E03C 1/01 52/27
3,618,278 A * 11/1971 Mouton, Jr. et al. ..... E04B 1/04 52/236.7
3,707,814 A * 1/1973 Seegers ..... E04F 11/02 52/185
3,720,024 A * 3/1973 Theisen ..... E04F 11/02 182/115

(Continued)

FOREIGN PATENT DOCUMENTS

CN 106829696 A * 6/2017
EP 0713942 A1 * 5/1996

(Continued)

*Primary Examiner* — James M Ference
(74) *Attorney, Agent, or Firm* — Mohr Intellectual Property Law Solutions, PC

(57) ABSTRACT

Level access structures including a first module and a second module. The first module includes first sidewalls defining a first open shaft with a first top end and a first bottom end opposite the first top end. The second module includes second sidewalls defining a second open shaft with a second top end and a second bottom end opposite the second top end. The second module is complementarily configured with the first level access module. The second module is configured to selectively couple to the first module with the second open shaft aligned with the first open shaft to define a continuous open shaft. The continuous open shaft is configured to contain a level access system.

18 Claims, 10 Drawing Sheets

(56) References Cited

U.S. PATENT DOCUMENTS 3,755,974 A * 9/1973 Berman ..... E04B 1/34869 52/73
3,788,018 A * 1/1974 Simmons ..... E04F 11/02 52/127.2
3,805,461 A * 4/1974 Jagoda ..... E04B 1/34823 52/79.14
3,830,026 A * 8/1974 Tylius ..... E04B 1/04 52/79.8
3,859,771 A * 1/1975 Simmons ..... E04F 11/02 52/741.2
3,952,471 A * 4/1976 Mooney ..... E04B 1/04 52/781.5
3,980,155 A * 9/1976 Campbell ..... A62B 1/20 182/49
3,991,528 A * 11/1976 Dillon ..... B66B 11/0005 52/79.14
4,244,154 A * 1/1981 Weaver ..... E04F 11/022 182/115
4,248,020 A * 2/1981 Zielinski ..... E04F 11/02 52/185
4,527,363 A * 7/1985 Saether ..... E04G 21/26 182/180.1
4,645,037 A * 2/1987 Gomez ..... E04F 17/005 52/185
4,930,273 A * 6/1990 Papesch ..... E04F 11/00 52/745.03
5,203,128 A * 4/1993 Bennett ..... E04F 11/025 52/190
5,203,707 A * 4/1993 Musto ..... A62C 99/0081 434/226
5,491,939 A * 2/1996 Wang ..... E04F 11/02 52/638
5,492,197 A * 2/1996 Yonahara ..... E04G 3/20 182/83
5,644,871 A * 7/1997 Cohen ..... E04B 5/04 52/125.4
D566,298 S * 4/2008 Bornhorst ..... E04F 11/02 D25/63
8,033,067 B2 * 10/2011 Miller ..... E04F 11/02 52/236.7
8,448,387 B2 * 5/2013 Hartmann ..... E04G 11/48 52/127.2
8,919,058 B2 * 12/2014 Liberman ..... E04B 1/34384 52/79.9
9,249,566 B2 * 2/2016 Eggleston ..... E04B 1/34823
10,494,771 B1 * 12/2019 Powell ..... E04H 3/12
11,702,855 B1 * 7/2023 Fan ..... E04F 11/022 52/167.3
2004/0098941 A1 * 5/2004 Cornell ..... E04H 12/10 52/651.01
2008/0115429 A1 * 5/2008 Zirbel ..... E04F 11/02 52/600
2008/0236065 A1 * 10/2008 Conservano ..... E04F 11/022 52/185
2009/0100614 A1 * 4/2009 Dale ..... B63B 27/14 14/71.3
2009/0249714 A1 * 10/2009 Combs ..... E04F 11/116 52/190
2010/0132271 A1 * 6/2010 Fernandez ..... E04B 1/34823 52/79.9
2011/0016800 A1 * 1/2011 Rutledge ..... E04B 2/8635 52/79.1
2011/0023383 A1 * 2/2011 Brouillard ..... E04B 1/34823 52/745.15
2011/0271613 A1 * 11/2011 Hopper ..... F03D 80/80 52/185
2020/0299982 A1 * 9/2020 Greschbach ..... E04G 23/0266
2021/0395042 A1 * 12/2021 Collins ..... E04F 11/18
2023/0056986 A1 * 2/2023 Berg ..... E04B 1/4114
2024/0344330 A1 * 10/2024 Cho ..... E04F 11/02
2025/0067056 A1 * 2/2025 Brotnov ..... E04F 11/035

FOREIGN PATENT DOCUMENTS

EP 3472402 B1 * 6/2024 ..... B66B 19/00
JP H07279341 A * 10/1995
JP 2005264600 A * 9/2005
KR 101054450 B1 * 8/2011
SU 806836 A1 * 2/1981

* cited by examiner

MODULAR LEVEL ACCESS STRUCTURES

BACKGROUND

The present disclosure relates generally to level access structures. In particular, modular level access structures are described.

Level access structures are used to access different levels of a building, such as a second floor or basement. Stairways and elevators are commonly used in level access structures. Level access structures can be configured to enable access between single floors or multiple floors of a building.

Known level access structures are not entirely satisfactory. For example, existing level access structures are often custom built at a job site and are insufficiently modular. The custom build nature of conventional level access structures makes them less sustainable. Installation speed is reduced, and installation is more labor intensive with conventional level access structures that are built on site.

Conventional level access structures also add risk and uncertainty to building installation projects. Delays can propagate through a building construction project from issues arising with building or installing custom level access structures. It would be desirable to mitigate timeline and cost risk with modular level access structures that arrive prebuilt and ready to install at a building construction site.

Another limitation of conventional level access structures is that they generally must be supported by a building. Conventional level access structures requiring support from a building constrains the building installation schedule by requiring that support for conventional level access structures be in place before installing the level access structures. It would be advantageous if level access structures were freestanding and could be installed with or without building infrastructure in place.

A further limitation of conventional level access structures is that they do not effectively accommodate drift that occurs during construction projects. Lateral drift and other deviations of structural members can occur during installation projects from a variety of factors. Accommodating drift allows for additional structures to be installed without reinstalling or correcting structural members that have drifted from their planned positions. It would be desirable to have level access structures that could effectively accommodate drift that invariably occurs during building construction projects.

Thus, there exists a need for level access structures that improve upon and advance the design of known level access structures. Examples of new and useful level access structures relevant to the needs existing in the field are discussed below.

SUMMARY

The present disclosure is directed to level access structures including a first module and a second module. The first module includes first sidewalls defining a first open shaft with a first top end and a first bottom end opposite the first top end.

The second module includes second sidewalls defining a second open shaft with a second top end and a second bottom end opposite the second top end. The second module is complementarily configured with the first level access module. The second module is configured to selectively couple to the first module with the second open shaft aligned with the first open shaft to define a continuous open shaft.

The continuous open shaft is configured to contain a level access system. The overall height of the continuous open shaft is determined by the number of modules coupled together.

DETAILED DESCRIPTION

Figure 1:
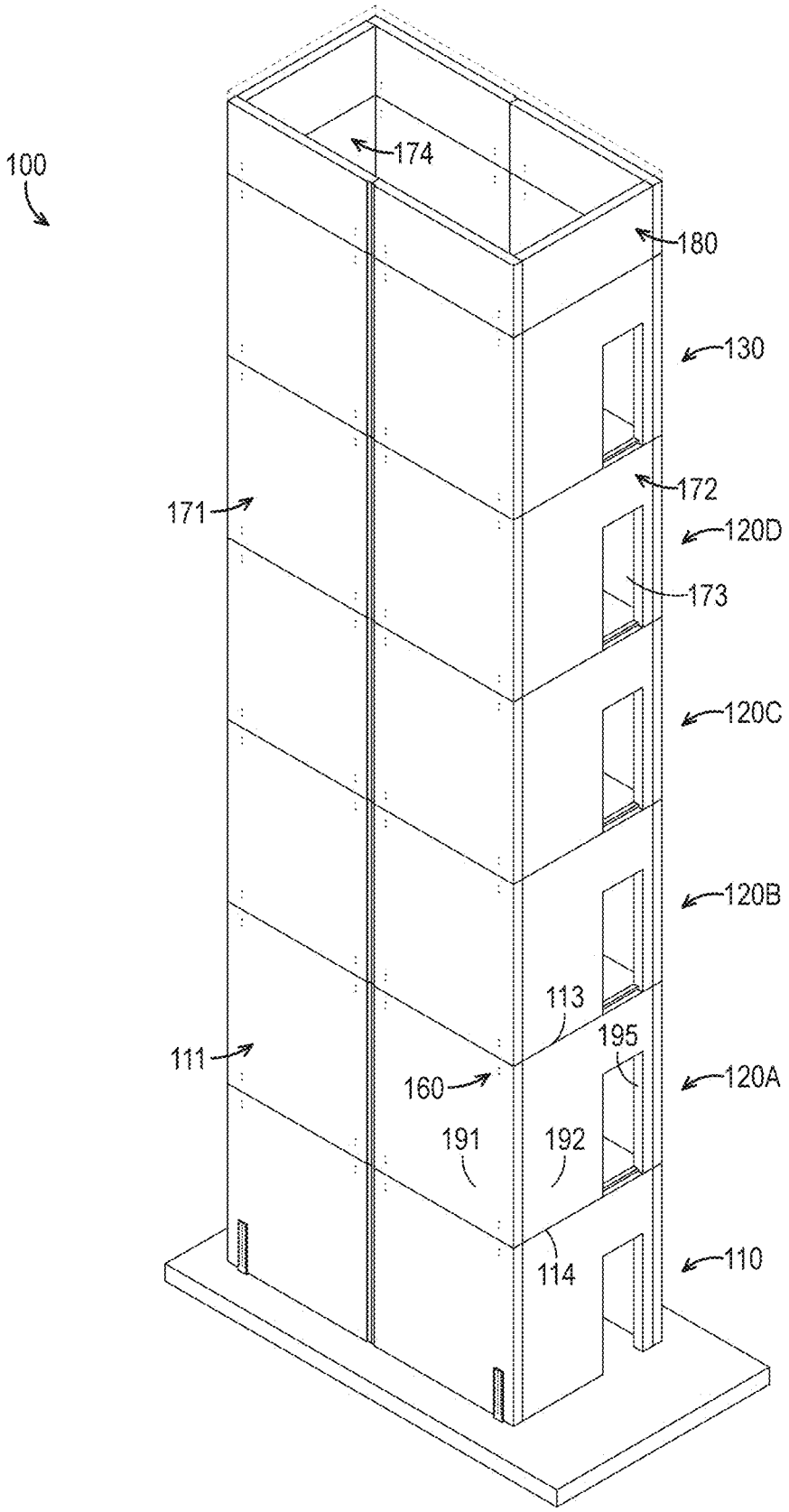
FIG. 1 is a perspective view of a first example of a level access structure.

The disclosed level access structures will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various level access structures are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Contextual Details

Ancillary features relevant to the level access structures described herein will first be described to provide context and to aid discussing the level access structures.

Building

The level access structures described herein are used to provide access to different levels or floors of a building. The level access structures may be utilized with a wide variety of buildings, including commercial, governmental, or education buildings; apartment complexes; hotels; and homes. Any building with different floors or levels, including subterranean levels, may utilize the level access structures described below.

Modular Level Access Structures

With reference to the figures, modular level access structures will now be described. The level access structures discussed herein function to enable access to different floors of a building via level access systems, such as staircases and elevators.

The reader will appreciate from the figures and description below that the presently disclosed level access structures address many of the shortcomings of conventional level access structures. For example, the novel level access structures are modular rather than custom built at a job site. The modular, prebuilt features of the novel level access structures increase sustainability, speed installation, and reduce labor compared to conventional level access structures that are built on site.

The novel level access structures described herein also mitigate risk and uncertainty with building installation projects. The novel level access structures reduce or entirely avoid delays that propagate through a building construction project from issues arising with building and installing custom level access structures. Desirably, the novel, modular level access structures mitigate timeline and cost risks by arriving prebuilt and ready to install at building construction sites.

Another advantage of the novel level access structures is that they are freestanding and can be installed with or without building infrastructure in place. Because the novel level access structures do not require support from a building, they do not constrain the building installation schedule by requiring that support for them be in place before they are installed.

Beneficially, the novel level access structures effectively accommodate drift that invariably occurs during building construction projects. Accommodating drift allows for the novel level access structures to be installed without reinstalling or correcting structural members that have drifted from their planned positions.

Level Access Structure Embodiment One

With reference to FIGS. 1-9, a first example of a level access structure, level access structure 100, will now be described. A second example of a level access structure, level access structure 200, is shown in FIG. 10 and discussed in the embodiment two section below.

Level access structure 100 includes a base module 110, multiple medial modules 120, and a roof module 130. The components of level access structure 100 are described in the sections below.

In some examples, the level access structure does not include one or more features included in level access structure 100. For example, some level access structure examples do not include a base module, a medial module, or a roof module. Some examples include fewer medial modules than depicted in the figures, such as a single medial module. In other examples, the level access structure includes additional or alternative features.

Figure 2:
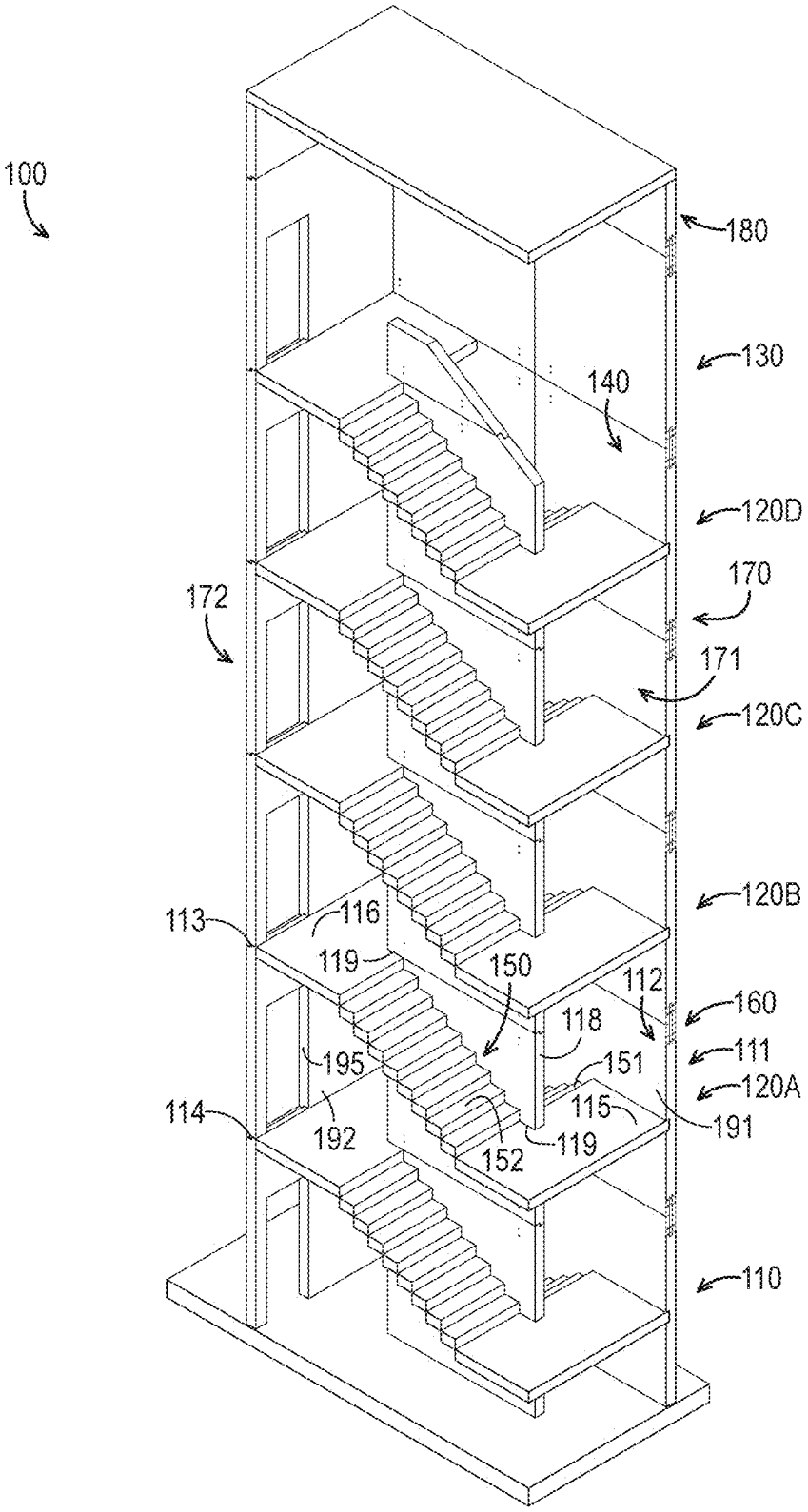
FIG. 2 is a perspective view of the level access structure shown in FIG. 1 with sidewall portions removed to depict internal features, including a staircase and landings.

As shown in FIGS. 1 and 2, level access structure 100 is freestanding without requiring support from the building in which it is used. Level access structure 100 being freestanding allows it to be installed independent of the building for which it provides access to different floors or levels. While not required for structural support, level access structure 100 is typically fastened to the building to link the building and level access structure together.

The size, shape, and appearance of the level access structure may differ than depicted in the figures or expressly described below. The reader should understand that the feature combinations described below may vary in form while maintaining the same functions as the specific components described below.

Medial Modules

The medial modules generally provide access to medial floors in a building, such as between the first floor and a second floor above a ground floor. The medial modules are distinct from the base modules and the roof modules because they define both top and bottom shaft openings rather than closing the open shaft on either a bottom side or a top side like the base module and the roof module, respectively. The medial modules are further distinct from the base modules by not including a base slab. The medial modules are distinct from the roof modules by not including a roof cap.

Multiple medial modules may be included in a level access structure depending on how many levels of access are required. For example, as shown in FIGS. 1 and 2, level access structure 100 includes four medial modules 120A, 120B, 120C, and 120D for use in a building with 4 medial levels (floors 1-4). In this document, medial modules in general are designated with reference number 120 and specific medial modules have sequential letter designations, such as 120A versus 120B, to differentiate specific medial modules.

In scenarios where access between two medial levels is required, such as between a first floor and a second floor, a single medial module is sufficient. In some examples, such as when a building does not have medial levels and instead includes only a ground floor and a top floor, no medial modules are included in the level access structure. Instead, the level access structure consists of a base module and a roof module.

Figure 9:
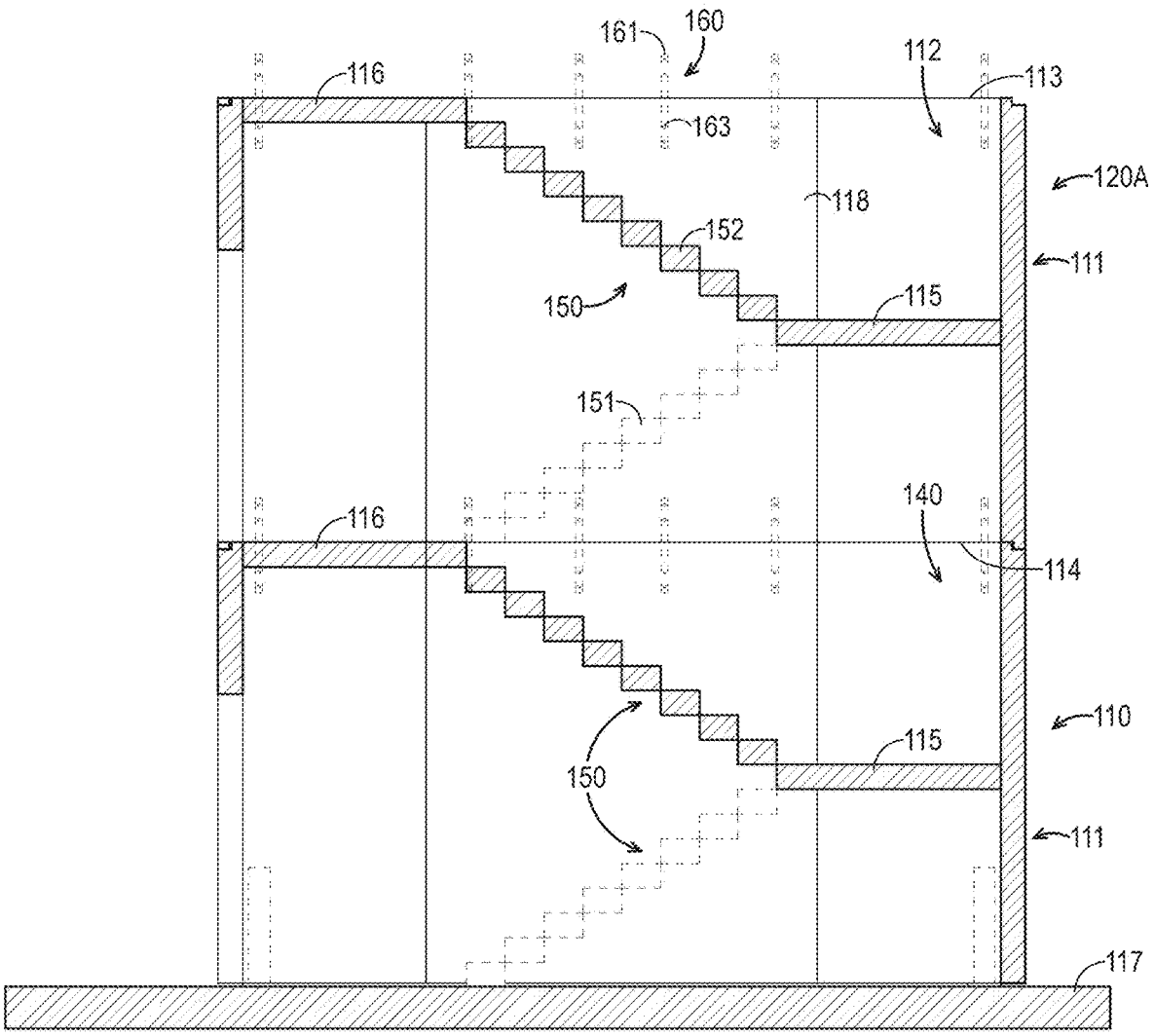
FIG. 9 is a section view of a portion of the level access structure shown in FIG. 1 including a medial module coupled on top of a base module.
Figure 10:
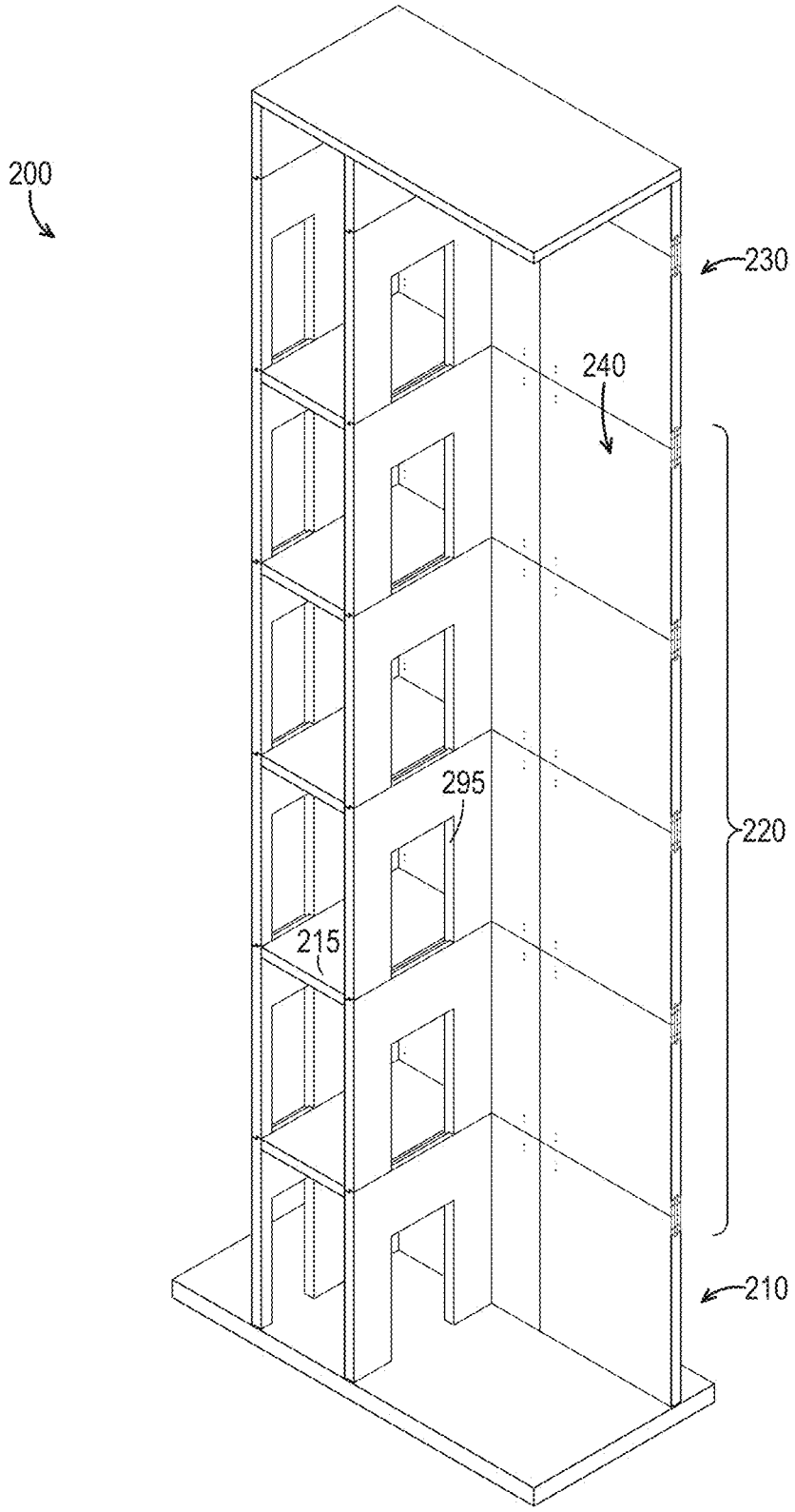
FIG. 10 is a perspective view of a second example of a level access structure with a continuous open shaft of the level access structure configured to contain an elevator.

A lowermost medial module (designated as medial module 120A in the figures) often attaches to base module 110 above base module 110, such as shown in FIGS. 1, 2, and 9. A topmost medial module (designated as medial module 120D in the figures) typically attaches to roof module 130 below roof module 130, such as shown in FIGS. 1 and 2. As shown in FIGS. 1 and 2, topmost medial module 120D attaches to medial module 120C above medial module 120C. The reader can see in FIGS. 1 and 2 that medial module 120B attaches to both medial module 120A and to medial module 120C above medial module 120A and below medial module 120C.

Each medial module includes sidewalls, a first landing, a second landing, a dividing wall, and pin systems. The sidewalls define an open shaft. For example, as shown in FIGS. 1, 2, 5, 8, and 9, medial module 120A includes sidewalls 111, a first landing 115, a second landing 116, a dividing wall 118, and pin systems 160. The components of the medial modules are described in the sections below.

Each medial module is complementarily configured with other medial modules and with base module 110 and roof module 130. The complementary configuration of the modules enables them to interchangeably connect to each other and to continue the open shaft between them. For example, as shown in FIG. 2, medial module 120B is configured to selectively couple to medial module 120A with the open shaft defined by medial module 120B aligned with open shaft 112 defined by medial module 120A.

With reference to FIG. 2, the aligned open shafts defined by the medial modules, the base module, and the roof module collectively define a continuous open shaft 140. Continuous open shaft 140 extends vertically between the different floors or level of a building. The height of the continuous open shaft is defined by the number of modules (base, medial, or roof) attached together.

Continuous open shaft 140 is configured to contain a level access system 150. In the example shown in FIGS. 1-9, level access system 150 is a staircase with a first flight of stairs 151 and a second flight of stairs 152. In the example shown in FIG. 10, continuous open shaft 240 is configured to receive a level access system in the form of an elevator.

Sidewalls

Figure 5:
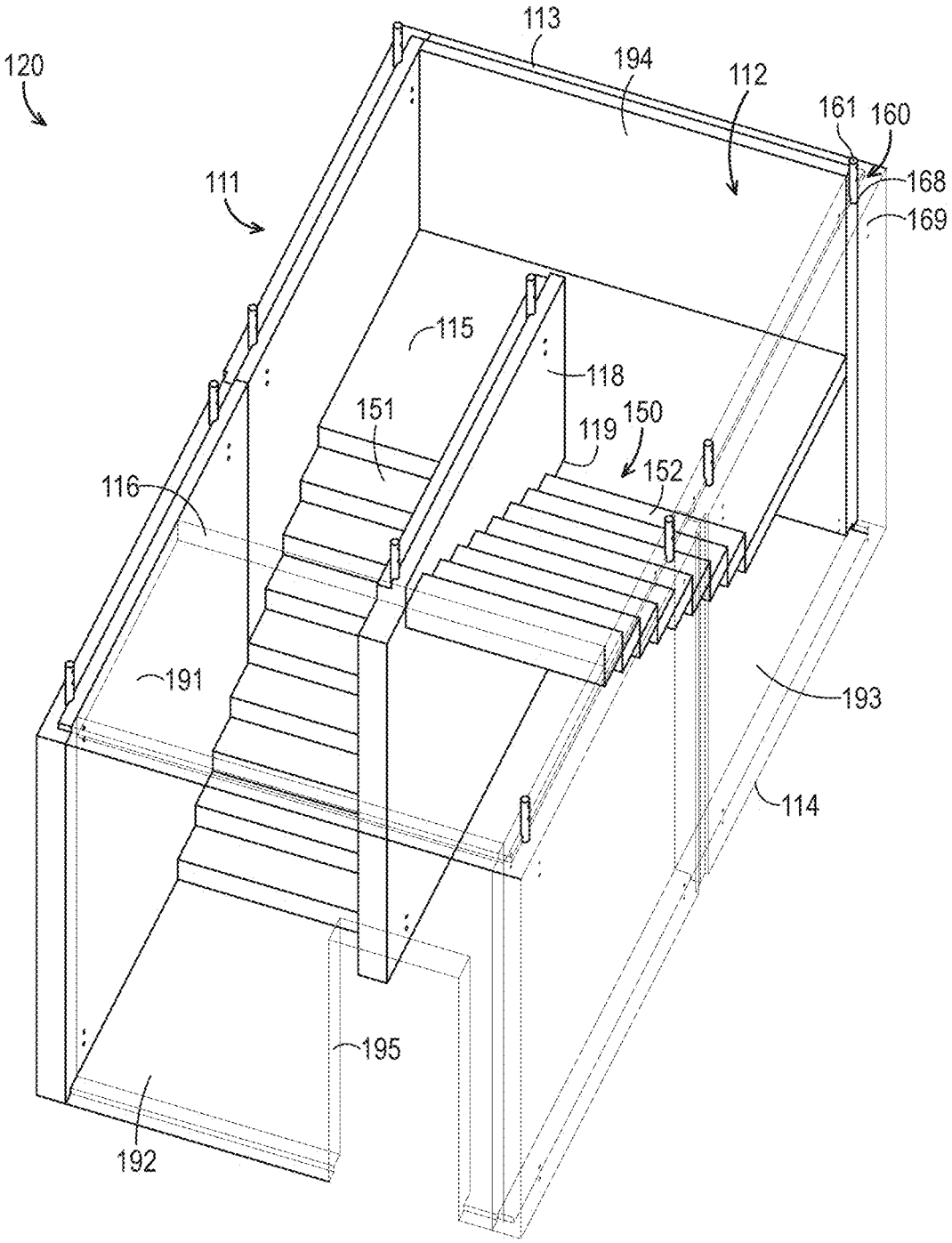
FIG. 5 is a perspective view of a medial module of the level access structure shown in FIG. 1.

Sidewalls 111 support components of level access structure, such as landings 115 and 116, level access system 150, and pin systems 160. Further, sidewalls 111 define the size, shape, and internal space of the medial modules. For example, as shown in FIGS. 2 and 5, sidewalls 111 define an open shaft 112 inside medial module 120A. Open shaft 112 has a top end 113 and a bottom end 114 opposite top end 113.

Figure 3:
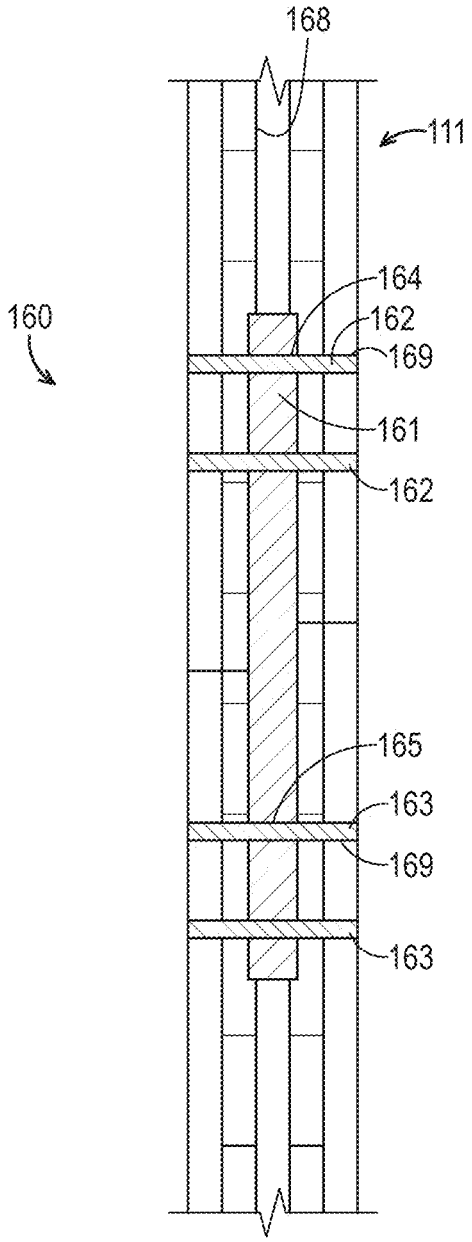
FIG. 3 is a detailed view of a pin system of the level access structure shown in FIG. 1 configured to selectively couple together modules of the level access structure.

As shown in FIG. 3, sidewalls 111 define vertical recesses 168 and sidewall bores 169. Dividing wall 118 also defines equivalent vertical recesses 168 and sidewall bores 169.

As depicted in FIGS. 1-9, vertical recesses 168 are disposed proximate adjoining modules to facilitate coupling modules together with pin systems 160. For example, sidewalls 111 include vertical recesses 168 proximate top end 113 of open shaft 112 and include vertical recesses 168 proximate bottom end 114 of open shaft 112. A vertical recess disposed proximate the top end of a lower module will be proximate a vertical recess disposed proximate the bottom end of an upper module positioned above the lower module.

With reference to FIG. 3, sidewall bores 169 extend horizontally through vertical recesses 168. As shown in FIG. 3, sidewall bores 169 are configured to receive horizontal pins 162 and 163 of pin system 160. As further shown in FIG. 3, vertical recesses 168 are configured to receive vertical pins 161 of pin system 160.

As apparent from FIGS. 2, 3, 5, 7 and 8, vertical pins 161 extend into vertical recesses 168 of adjoining modules to link the modules together. As shown in FIG. 3, horizontal pins 162 and 163 extend through sidewall bores 169 and through vertical pins 161 disposed in vertical recesses 168. Horizontal pins 162 and 163 secure vertical pins 161 to sidewalls 111 or dividing wall 118 within vertical recesses 168.

The number of vertical recesses and horizontal bores may vary in different examples. In the present example, with reference to FIGS. 1, 2, 5, and 7-9, each module includes eight vertical recesses 168 and horizontal recess pairs 169 (collectively referred to as a recesses set) near the top of the module and eight recesses sets near the bottom of the modules. As apparent from FIG. 5, dividing wall 118 includes two longitudinally spaced recess sets near the top of dividing wall 118 and two longitudinally spaced recess sets near the bottom of dividing wall 118.

As shown in FIGS. 1, 2, 5, and 7-9, the sixteen total recess sets of sidewalls 111 are distributed around sidewalls 111 to facilitate coupling modules together securely around the modules and to provide balanced mounting points for hoisting the modules. Four recess sets of sidewalls 111 are disposed near the corners of the modules at the upper end of the modules and four recess sets are disposed near the corners of the modules at the lower end of the modules. Four further recesses sets are disposed near the center of the modules (two each on opposite sides of the module) on both the upper and lower ends of the module.

Sidewalls 111 of each medial module 120 (as well as base module 110 and roof module 120) include multiple walls. In the example shown in FIGS. 1-9, each module includes a first sidewall 191, a second sidewall 192, a third sidewall 193, and a fourth sidewall 194.

Figure 8:
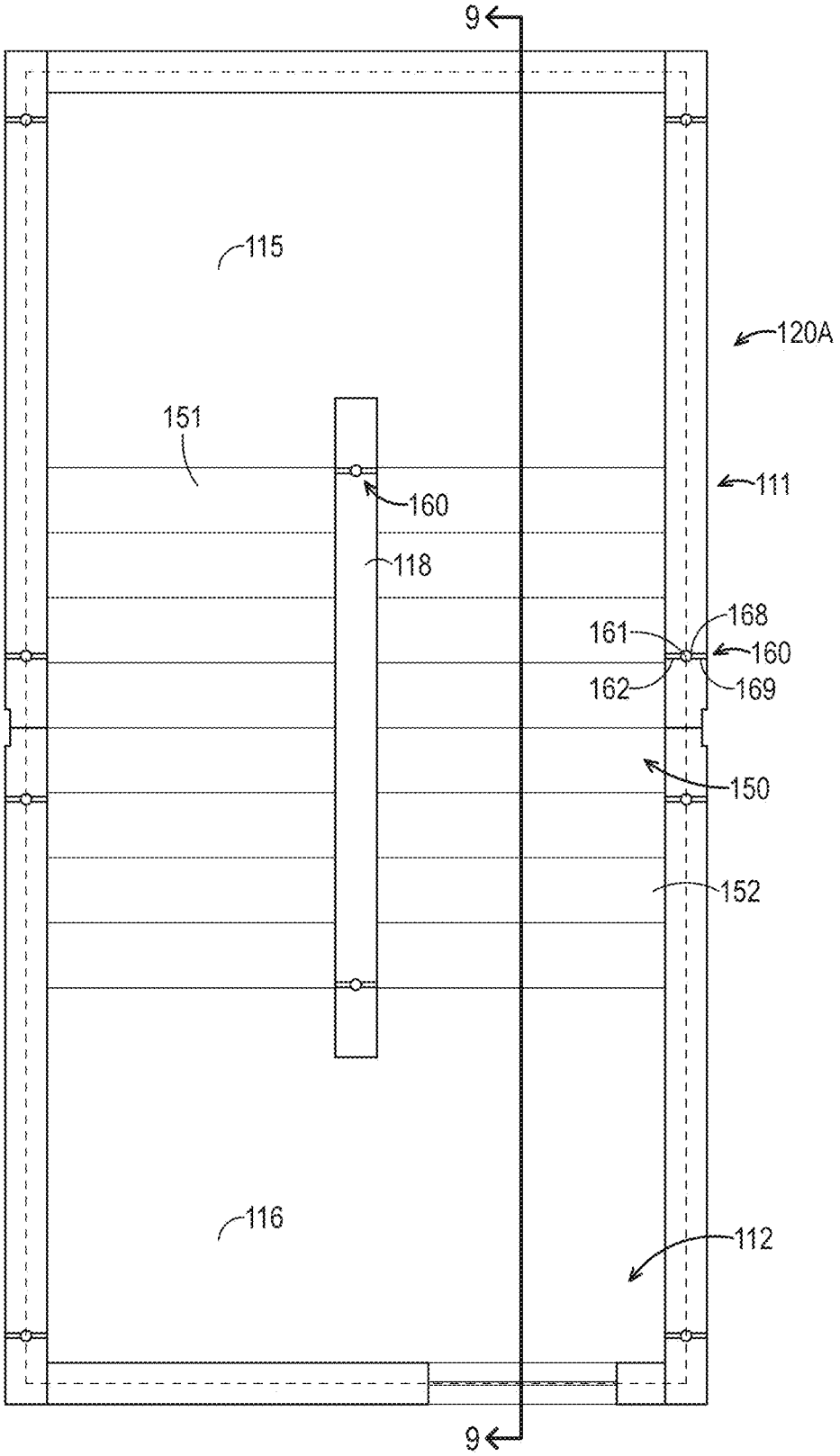
FIG. 8 is a plan view of a base module of the level access structure shown in FIG. 1.

As shown in FIGS. 1, 5, and 8, the four sidewalls connect at terminal ends and form a rectangle. However, the number of sidewalls, where they connect to each other, and the shape they define may vary in different examples. For instance, the sidewalls may define a triangle shape with three distinct sidewalls. In some examples, a single sidewall defines a circle or oval shape.

Figure 7:
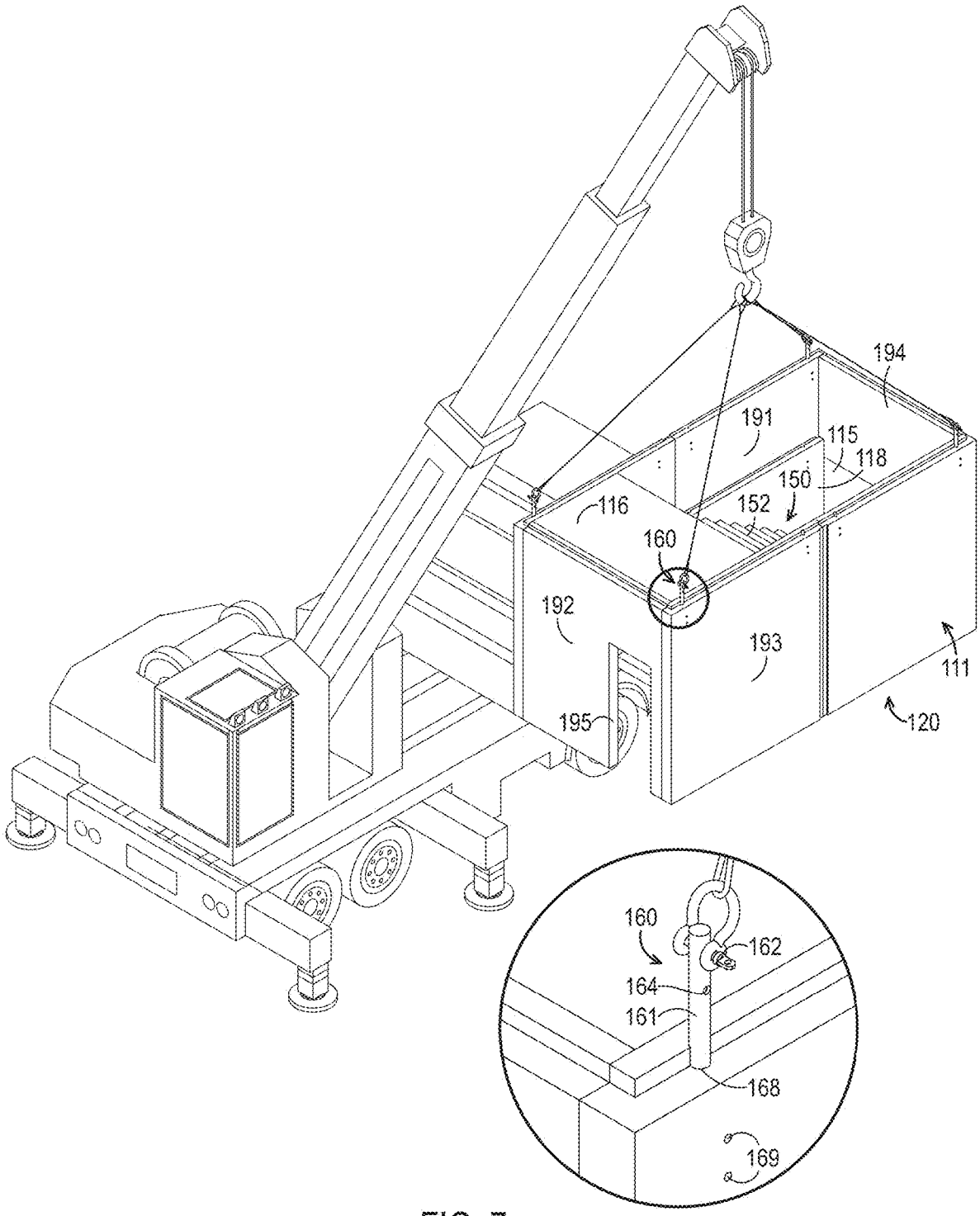
FIG. 7 is a view of a crane hoisting a module of the level access structure shown in FIG. 1 by coupling to a horizontal shaft of a pin system of the level access structure.

With reference to FIGS. 5, 7, and 8, first sidewall 191 connects to second sidewall 192 on one end and to fourth sidewall 194 on an opposite end. First sidewall 191 is disposed across open shaft 112 from third sidewall 193. Second sidewall 192 connects to first sidewall 191 on one end and to third sidewall 193 on an opposite end. Second sidewall 192 is disposed across open shaft 112 from fourth sidewall 194. Third sidewall connects to second sidewall 192 on one end and to fourth sidewall 194 on an opposite end. Fourth sidewall 194 connects to first sidewall 191 on one end and to third sidewall 193 on an opposite end.

Second sidewall 192 may be referred to as an access sidewall. As shown in FIGS. 1, 2, 5, and 7-9, access sidewall 192 defines a doorway 195. As apparent from FIGS. 1 and 2, doorway 195 provides access to open shaft 112 of a given module. In the present example, doorway 195 is defined proximate bottom end 114 of open shaft 112, but may be defined in other locations in other examples.

When modules (base, medial, or roof) are attached together with their respective sidewalls 111 aligned, sidewalls 111 define continuous sidewalls 170. Continuous sidewalls 170 include a first continuous sidewall 171, a second continuous sidewall 172, a third continuous sidewall 173, and a fourth continuous sidewall 174. First continuous sidewall 171 is defined by multiple aligned first sidewalls 191; second continuous sidewall 171 is defined by multiple aligned second sidewalls; etc.

Landings

The landings provide horizontal surfaces on which people may access level access system 150 within the modules. The landings also enable a person to access doors formed in sidewalls 111 to enter and exit the modules.

The landings are supported by sidewalls 111 in each module. For example, first landing 115 is supported from sidewalls 111 at a medial level of open shaft 112. As depicted in FIGS. 2, 5, and 9, first landing 115 is supported from sidewalls 111 between bottom end 114 and top end 113 of open shaft 112. First landing 115 extends horizontally into open shaft 112.

Second landing 116 is supported from sidewalls 111 proximate top end 113 of open shaft 112. As apparent from FIGS. 2, 5, and 9, second landing 116 extends horizontally into open shaft 112. Second landing 116 functions as a floor or bottom landing for a module mounted above.

The landings may be configured in any suitable flooring configuration with any suitable flooring material. In examples where the level access system is an elevator, landings may not be included in the level access structure.

Dividing Wall

Dividing wall 118 functions to laterally separate flights of stairs of level access system 150. Dividing wall 118 is an optional feature and is not included in all level access system examples. For instance, some module examples with staircases do not include dividing walls. Further, dividing walls are not included in examples where the level access system is an elevator.

As depicted in FIGS. 2, 5, and 8, dividing wall 118 is disposed between first flight of stairs 151 and second flight of stairs 152. Rather than mounting to sidewalls 111, dividing wall 118 is mounted to first flight of stairs 151 and second flight of stairs 152. With reference to FIGS. 2, 5, and 8, the reader can see that first landing 115 and second landing 116 define a notch 119 configured to receive dividing wall 118.

The dividing wall may be configured as any suitable wall configuration with any suitable exterior material, including brick, drywall, or wood paneling. The size and shape of the dividing wall may vary in different examples to suit different needs and aesthetic design considerations.

Pin Systems

Pin systems 160 are configured to selectively couple modules together. Pin systems 160 are adapted to couple together base module 110 to medial module 120A; one medial module to another medial module; medial module 120D to roof module 130; and/or base module 110 to roof module 130. Further, pin systems 160 are configured to serve as mounting points for a hoist or other lifting device to enable lifting and moving the modules to desired positions.

As shown in FIG. 3, each pin system 160 includes a vertical pin 161 and horizontal pins 162 and 163. As apparent from FIG. 9, vertical pin 161 is disposed within vertical recesses 168 of adjoining modules; for example, within a top vertical recess of a lower module and also within an aligned lower vertical recess of an upper module above the lower module. Vertical pin 161 disposed within vertical recesses of adjoining modules couples the modules together at the sidewalls.

As depicted in FIG. 3, vertical pin 161 defines pin bores 164 and 165 extending horizontally through vertical pin 161. Pin bore 164 is disposed within a vertical recess 168 of a first module and is aligned with sidewall bore 169 of the first module. Pin bore 165 is disposed within vertical recess 168 of a second module and is aligned with sidewall bore 169 of the second module.

With reference to FIG. 3, the reader can see that horizontal pin 162 is configured to selectively extend through sidewall bore 169 of the first module and through pin bore 164 to couple vertical pin 161 to sidewalls 111 of the first module. With continued reference to FIG. 3, horizontal pin 163 is configured to selectively extend through sidewall bore 169 of the second module and through pin bore 165 to couple vertical pin 161 to sidewalls 111 of the second module.

Horizontal pin 163 extending through sidewall bore 169 and pin bore 164 or 165 also defines a mounting point. As depicted in FIG. 7, the mounting point enables hoisting the module with a crane or other lifting device.

In the example depicted in FIG. 7, anchor shackles link cables of a crane to horizontal pins 162 extending through vertical pins 161 at 4 locations around module 120 to enable lifting module 120 with the crane. In some examples, a strap or hook of the crane or other lifting device engages the horizontal pins to lift the module. Typically the lifting device links to multiple horizontal pins 162 disposed around the module to lift it in a balanced and substantially horizontal orientation.

In some examples, horizontal pin 162 is replaced with a different horizontal pin after the module is hoisted into place. The replacement horizontal pin may be less structurally robust than horizontal pin 162 used for hoisting the module, but sufficiently robust for retaining vertical pin 161 within vertical recess 168. Replacing horizontal pin 162 with less structurally robust horizontal pins may reduce costs by relying on less expensive pins as permanent linking members and reusing the more expensive, more structurally robust pins for lifting different modules.

Horizontal pin 162 is composed of steel to provide sufficient structural strength and rigidity for it to serve as a lift engagement point. However, the horizontal pin may be comprised of any currently known or later developed material with sufficient strength and rigidity to serve as a mounting point. The replacement horizontal pin used exclusively for retaining the vertical pin in the vertical recess may be any currently known or later developed material suitable for pin retention, which may be a less structurally robust material than steel.

Base Module

Base module 110 serves as a foundation for level access structure 100 by supporting one or more medial modules 120 and/or roof modules 130 from below. For example, as shown in FIGS. 1, 2, and 9, medial module 120A is mounted on top of base module 110.

Figure 4:
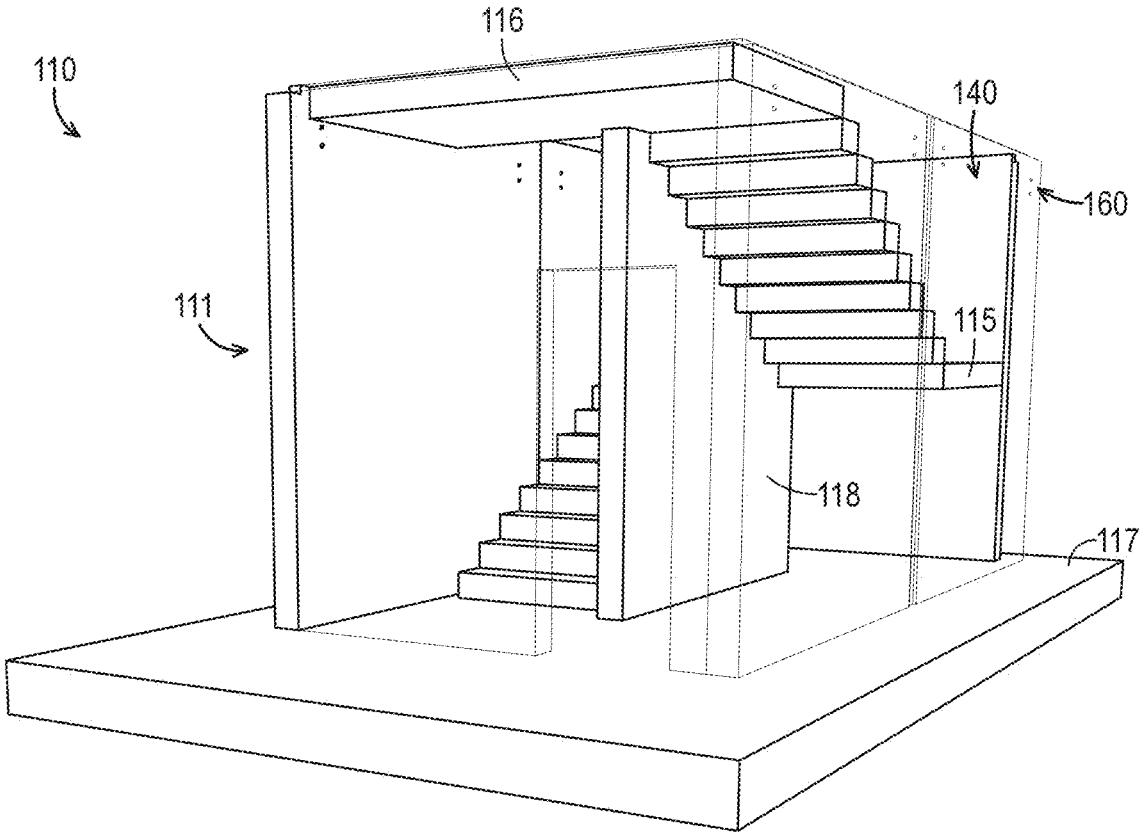
FIG. 4 is a perspective view of a base module of the level access structure shown in FIG. 1.

Base module 110 also functions to provide access between floors or levels of a building via level access system 150, such as between a ground floor and a first floor as depicted in FIGS. 1, 2, and 9. In some examples, the base module provides access between a basement level and a ground floor. As shown in FIGS. 2, 4, and 9, base module 110 further serves to enclose continuous open shaft 140 from below.

Base module 110 is configured similarly to medial modules 120 described above with a few unique features. The features in common between the modules, such as sidewalls 111, first and second landings 115 and 116, dividing walls 118, and pin systems 160, are described above and will not be redundantly described again in this section. Unique, defining features of base module 110 are described in this section.

As shown in FIGS. 1, 2, 4, and 9, base module 110 includes sidewalls 111, first and second landings 115 and 116, dividing wall 118, pin systems 160, and a base slab 117. Base slab 117 is a feature unique to base module 110 relative to medial modules 120.

As apparent from FIGS. 1, 2, 4, and 9, base slab 117 is disposed below sidewalls 111 and level access system 150. Base slab 117 serves as a floor for base module 110 and as a structural foundation for a column of modules stacked together.

Base slab 117 is formed from concrete, but may be formed from any currently known or later developed material suitable for foundation applications. The size and shape of the base slab may vary in different examples than depicted in the figures.

Roof Module

Roof module 130 is configured to enclose continuous open shaft 140 from above. As shown in FIGS. 1 and 2, roof module 130 selectively mounts on top of medial module 120D. In other examples, the roof module mounts on top of a base module.

Roof module 130 is configured with selected features in common with medial modules 120 described above and with a few unique features. The features in common between the modules, such as sidewalls 111, dividing walls 118, and pin systems 160, are described above and will not be redundantly described again in this section. Unique, defining features of roof module 130 are described in this section.

Figure 6:
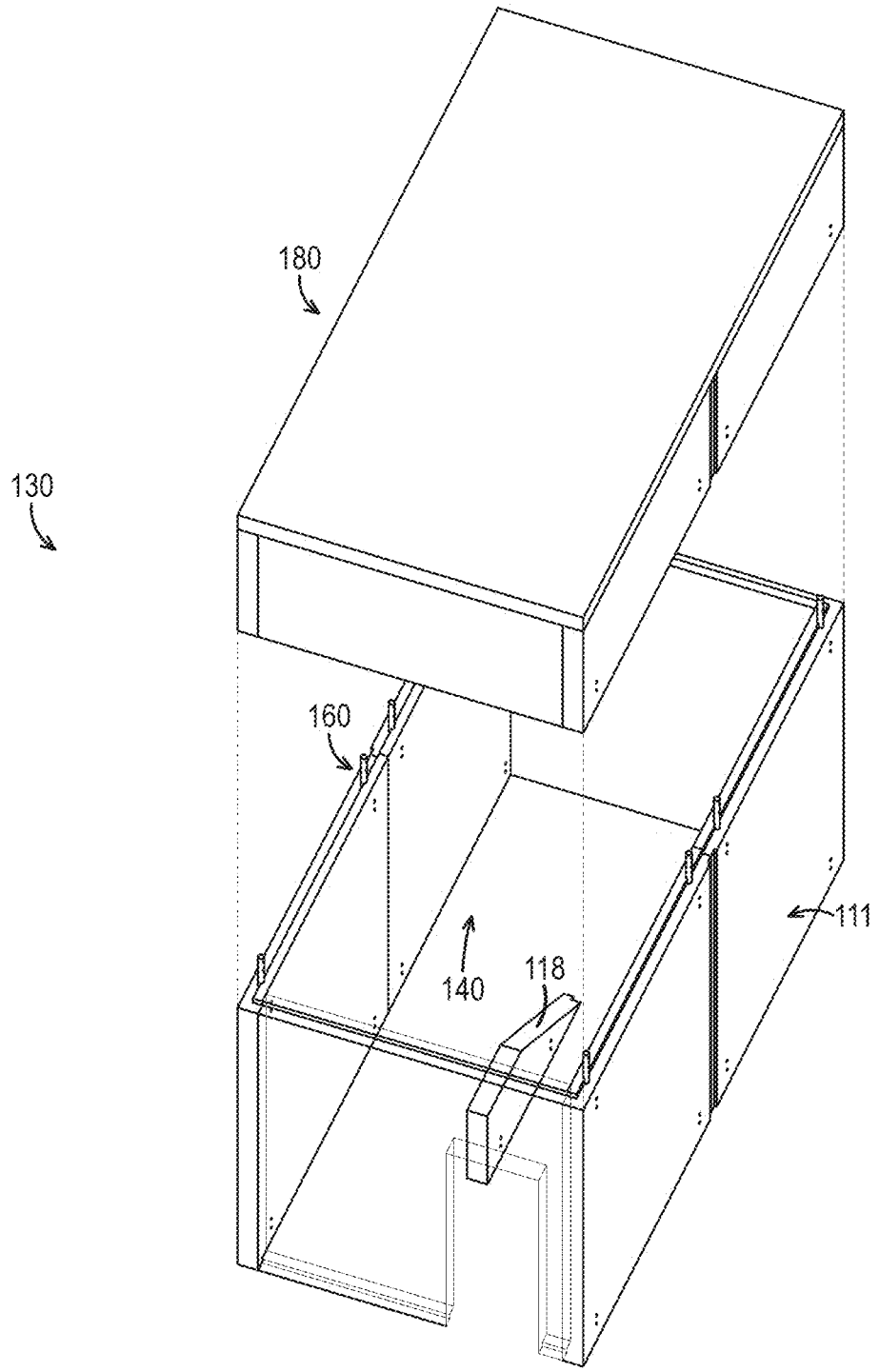
FIG. 6 is a perspective view of a roof module of the level access structure shown in FIG. 1.

As shown in FIGS. 1, 2, and 6, roof module 130 includes sidewalls 111, dividing wall 118, pin systems 160, and a roof cap 180. In some examples, the roof module includes a ceiling as an optional feature separate from the roof cap. In examples with a ceiling, the ceiling serves as an upper horizontal surface above level access system 150 to mount lights or other features and for interior design aesthetics. In examples without a ceiling, roof cap 180 functions as the upper horizontal surface.

Roof cap 180 is a feature unique to roof module 130 relative to medial modules 120. As shown in FIGS. 1, 2, and 6, roof cap 180 functions to enclose continuous open shaft 140. As shown in FIGS. 1, 2, and 6, roof cap 180 mounts on top of sidewalls 111 of roof module 130 via pin systems 160. The size, shape, and overall configuration of the roof cap may vary in different examples.

In the example shown in FIGS. 1, 2, and 6, roof cap 180 is a separate component that mounts to sidewalls 111 after sidewalls 111 are mounted to medial module 120D below. In other examples, the roof cap is integral to the other components of the roof module.

Level Access System

Level access system 150 provides access to different levels of a building. For example, the level access system may enable one to move from the ground floor to the second floor. Alternatively, the level access system may enable one to move from a top floor to the ground floor with multiple intermediary floors between the top floor and the ground floor.

In the example shown in FIGS. 1-9, level access system 150 is a staircase with first flight of stairs 151 and second flight of stairs 152. In the example shown in FIG. 10, the level access system is an elevator (not depicted). Level access system 150 is disposed in continuous open shaft 140.

In some examples, the level access structure includes the level access system disposed in the continuous open shaft. In other examples, the level access system is not included in the level access system, but rather the level access system accommodates the level access system. For example, a project may entail using a level access system supplied by a third party and the level access system may be designed to accommodate and couple to the third-party level access system.

Level access system 150 mounts to sidewalls 111 in each module. For example, as shown in FIG. 5, first flight of stairs 151 is mounted to first sidewall 191. Second flight of stairs 152 is mounted to third sidewall 193. First flight of stairs 151 extends from bottom end 114 of open shaft 112 to first landing 115. Second flight of stairs 152 extends from first landing 115 to second landing 116 proximate top end 113 of open shaft 112.

Additional Embodiment

With reference to FIG. 10 not yet discussed in detail, the discussion will now focus on an additional level access structure embodiment. The additional embodiment includes many similar or identical features to level access structure 100. Thus, for the sake of brevity, each feature of the additional embodiment below will not be redundantly explained. Rather, key distinctions between the additional embodiment and level access structure 100 will be described in detail and the reader should reference the discussion above for features substantially similar between the different level access structure examples.

Level Access Structure Embodiment Two

Turning attention to FIG. 10, a second example of a level access structure, level access structure 200, will now be described. As can be seen in FIG. 10, level access structure 200 includes multiple modules, including a base module 210, medial modules 220, and a roof module 230. A distinction between level access structure 200 and level access structure 100 is that the level access system accommodated by level access system 200 is an elevator (not pictured) rather than a staircase.

Because level access structure 200 is configured for an elevator, modules 210, 220, and 230 are configured differently than modules 110, 120, and 130. The primary difference between the modules in structure 200 versus structure 100 is that modules 210, 220, and 230 do not include landings inside continuous open shaft 240 like in continuous open shaft 140. Instead, continuous open shaft 240 is more fully open than continuous open shaft 140 to accommodate the elevator extending between the modules of level access structure 200.

While landings are not present inside continuous open shaft 240, the reader can see in FIG. 10 that the modules each include a landing 215 adjacent to continuous open shaft 240. As shown in FIG. 10, landing 215 is proximate a doorway 295 providing access to continuous open shaft 240. A user may walk on landing 215 and pass through doorway 295 to step inside an elevator car disposed in continuous open shaft 240. In some examples, the level access structure does not include landings and instead the doorway providing access to continuous open shaft and the elevator within it is in a peripheral sidewall of the level access structure.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A level access structure, comprising:
a first module including first sidewalls defining a first open shaft with a first top end and a first bottom end opposite the first top end;
a second module including second sidewalls defining a second open shaft with a second top end and a second bottom end opposite the second top end; and
a pin system configured to selectively couple the second module to the first module at a building site;
wherein:
the second module is complementarily configured with the first module;
the second module is configured to selectively couple to the first module with the second open shaft aligned with the first open shaft to define a continuous open shaft;
the first module and the second module are prebuilt remote from the building site as complete, freestanding, modular structures ready to be selectively coupled together at the building site;
the first sidewalls define a vertical recess proximate the second module;
the second sidewalls define a second vertical recess proximate the first module and aligned with the first vertical recess when the second module selectively couples to the first module;
the pin system includes a vertical pin disposed within the first vertical recess and the second vertical recess to couple the first sidewalls to the second sidewalls;
the continuous open shaft is configured to contain a level access system;
the first sidewalls define a first sidewall bore extending horizontally through the first vertical recess;
the second sidewalls further define a second sidewall bore extending horizontally through the second vertical recess;
the vertical pin defines pin bores extending horizontally through the vertical pin, the pin bores including a first pin bore disposed within the first vertical recess and aligned with the first sidewall bore and a second pin bore disposed within the second vertical recess and aligned with the second sidewall bore; and
the pin system further includes:
a first horizontal pin configured to selectively extend through the first sidewall bore and the first pin bore to couple the vertical pin to the first sidewall; and
a second horizontal pin configured to selectively extend through the second sidewall bore and the second pin bore to couple the vertical pin to the second sidewall.

2. The level access structure of claim 1, wherein the continuous open shaft is configured to contain an elevator.

3. The level access structure of claim 1, wherein:
the level access structure includes the level access system disposed in the continuous open shaft; and
the level access system is a staircase.

4. The level access structure of claim 3, wherein the first module includes:
a first landing supported from the first sidewalls at a medial level between the first bottom end and the first top end and extending horizontally into the first open shaft; and
a second landing supported from the first sidewalls proximate the first top end and extending horizontally into the first open shaft.

5. The level access structure of claim 4, wherein the staircase includes:
a first flight of stairs extending from the first bottom end to the first landing; and
a second flight of stairs extending from the first landing to the second landing.

6. The level access structure of claim 5, wherein:
the first sidewalls aligned with the second sidewalls define continuous sidewalls;
the continuous sidewalls include:
a first sidewall; and
a second sidewall spaced from the first sidewall across the continuous open shaft;
the first flight of stairs is mounted to the first sidewall; and
the second flight of stairs is mounted to the second sidewall.

7. The level access structure of claim 6, further comprising a dividing wall disposed between the first flight of stairs and the second flight of stairs.

8. The level access structure of claim 7, wherein the dividing wall is mounted to the first flight of stairs and the second flight of stairs.

9. The level access structure of claim 7, wherein the first landing defines a notch configured to receive the dividing wall.

10. The level access structure of claim 1, wherein the first horizontal pin disposed in the first sidewall bore defines a mounting point to hoist the first module with a crane.

11. The level access structure of claim 10, wherein the first horizontal pin is composed of steel.

12. The level access structure of claim 1, wherein the second module selectively couples to the first module with the second bottom end abutting the first top end.

13. The level access structure of claim 12, further comprising a roof module configured to selectively mount on top of the second module and to enclose the continuous open shaft from above.

14. The level access structure of claim 13, further comprising a base module configured to selectively couple to the first module at the first bottom end and to enclose the continuous open shaft from below.

15. The level access structure of claim 14, wherein the base module includes a base slab configured to support the first module, the second module, and the roof module from the ground.

16. The level access structure of claim 15, wherein the level access structure is freestanding.

17. The level access structure of claim 1, wherein the first sidewalls include an access sidewall defining a doorway providing access to the first open shaft.

18. A level access structure, comprising:

a first module including first sidewalls defining a first open shaft with a first top end and a first bottom end opposite the first top end;

a second module including second sidewalls defining a second open shaft with a second top end and a second bottom end opposite the second top end; and a pin system configured to selectively couple the second module to the first module;

wherein:

the second module is complementarily configured with the first module;

the second module is configured to selectively couple to the first module with the second open shaft aligned with the first open shaft to define a continuous open shaft;

the continuous open shaft is configured to contain a level access system;

the first sidewall defines:

a first vertical recess proximate the second module; and a first sidewall bore extending horizontally through the first vertical recess;

the second sidewall defines:

a second vertical recess proximate the first module and aligned with the first vertical recess when the second module selectively couples to the first module; and a second sidewall bore extending horizontally through the second vertical recess; and the pin system includes:

a vertical pin disposed within the first vertical recess to the second vertical recess to couple the first sidewalls to the second sidewalls, the vertical pin defining pin bores extending horizontally through the vertical pin, the pin bores including a first pin bore disposed within the first vertical recess and aligned with the first sidewall bore and a second pin bore disposed within the second vertical recess and aligned with the second sidewall bore;

a first horizontal pin configured to selectively extend through the first sidewall bore and the first pin bore to couple the vertical pin to the first sidewall; and a second horizontal pin configured to selectively extend through the second sidewall bore and the second pin bore to couple the vertical pin to the second sidewall.

* * * * *